United States Patent [19]

Burmeister et al.

[11] Patent Number: 5,042,360

[45] Date of Patent: Aug. 27, 1991

[54] HYDRAULIC REGENERATIVE STARTER/SPEED REGULATOR FOR A GUN GAS POWERED GATLING GUN

[75] Inventors: Richard A Burmeister, Lake Orion; Stephen I. Kaylor, Oxford; Carel J. F. Mali, Union Lake, all of Mich.

[73] Assignee: M.C. Aerospace Corporation, Lake Orion, Mich.

[21] Appl. No.: 812,583

[22] Filed: Dec. 23, 1985

[51] Int. Cl.[5] ..... F41F 1/10

[52] U.S. Cl. ..... 89/12; 89/160

[58] Field of Search ..... 89/160, 162, 12, 13.05, 89/126, 127

[56] References Cited

U.S. PATENT DOCUMENTS

| | | | |
|---|---|---|---|
| 3,991,650 | 11/1976 | Garland et al. | 89/126 |
| 4,046,056 | 9/1977 | Carrie | 89/12 |
| 4,924,753 | 5/1990 | Tassie et al. | 89/160 |

*Primary Examiner*—Deborah L. Kyle
*Assistant Examiner*—Stephen M. Johnson
*Attorney, Agent, or Firm*—Joseph W. Farley

[57] ABSTRACT

The present invention relates to a regenerative hydraulic starter/speed regulator system for providing initial rotation and acceleration of a rotatable barrel cluster of a gun gas driven Gatling gun, and for controlling the speed of the barrel cluster during the firing of the gun. The hydraulic system includes a high pressure accumulator for containing a supply of pressurized hydraulic fluid. A hydraulic motor/pump unit is connected to either drive or be driven by the barrel cluster, depending on whether the motor/pump unit is operated in either the motoring or pumping mode. Initially, a servo mechanism operates the motor/pump unit in the motoring mode wherein pressurized fluid from the accumulator is supplied to the motor/pump unit to initially rotate and accelerate the barrel cluster in a firing direction until the rotation of the barrel cluster is sustained by the gun gas drive unit. Thereafter, the servo mechanism operates the motor/pump unit in the pumping mode wherein said motor/pump unit is powered by the gun gas driven barrel cluster to supply pressurized fluid to recharge the accumulator. Also, during the firing mode, the motor/pump unit can be operated in the pumping mode to maintain the speed of the barrel cluster at a desired firing speed.

18 Claims, 4 Drawing Sheets

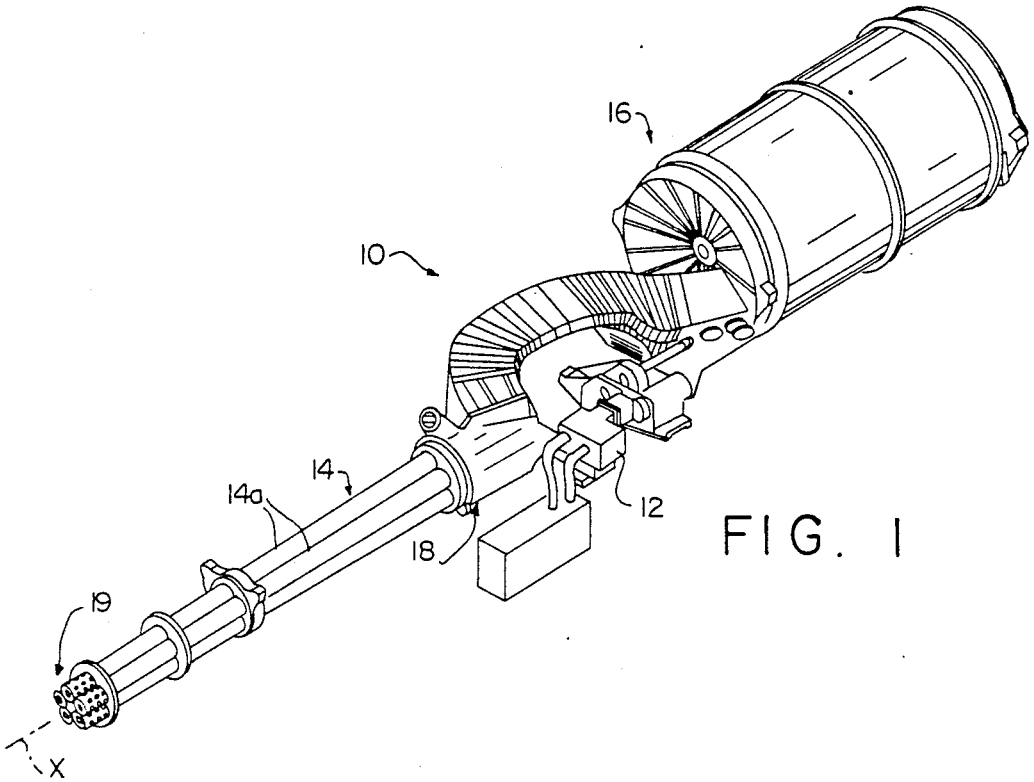
FIG. 1
FIG. 2
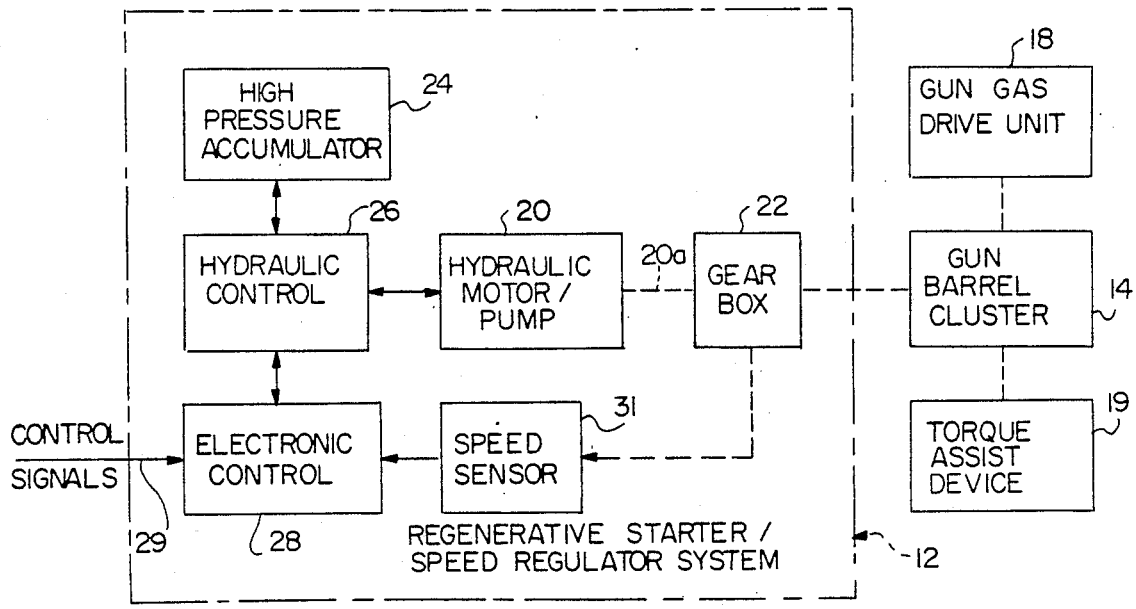

HYDRAULIC REGENERATIVE STARTER/SPEED REGULATOR FOR A GUN GAS POWERED GATLING GUN

BACKGROUND OF THE INVENTION

The present invention relates generally to a gun gas driven Gatling gun assembly and, in particular, to a hydraulic system for providing initial rotation and acceleration of the barrel cluster of the gun and for also regulating the rotational speed of the barrel cluster during the firing mode.

While Gatling type guns have been well known for over a century, they continue to be found in the current military arsenal. A Gatling type gun includes a plurality of individual barrels arranged in a circular barrel cluster for rotation about a common longitudinal gun axis. As the barrel cluster is rotated, the individual barrels are serially loaded with ammunition, fired, and subsequently cleared for reloading. Such a construction enables the gun to achieve a very high firing rate.

Over the years, various types of drive mechanisms have been proposed for rotating the barrel cluster. One of the earliest Gatling gun mechanisms is disclosed in U.S. Pat. No. 36,836 issued Nov. 4, 1862 to R. J. Gatling and utilizes a manual crank for rotation of the barrel cluster. Other drive mechanisms, such as the gun system disclosed in U.S. Pat. No. 3,407,701, have utilized either a separate electric or fluid motor to rotate the barrel cluster.

Some drive mechanisms incorporate a gun gas drive unit wherein the energy produced by the gases generated during the discharge of the ammunition from the individual barrels is harnessed to drive the barrel cluster While a gun gas drive system can provide sufficient power to rotate the gun barrel once the firing has commenced, it is necessary to provide a separate power source to provide for initial acceleration and rotation of the barrel cluster and also to provide for any reversing of the barrel cluster. An example of a gun gas driven Gatling gun which includes an externally powered system is disclosed in U.S. Pat. No. 4,046,056.

SUMMARY OF THE INVENTION

The present invention relates to an improved self starting system for providing initial rotation and acceleration of a rotatable barrel cluster of a gun gas driven Gatling gun. In addition to providing initial rotation and acceleration of the barrel cluster, the hydraulic system of the present invention also regulates the speed of the gun during the firing mode, provides the necessary braking of the barrel cluster at the termination of the firing mode and, after braking, provides the necessary reversing of the barrel cluster in order to clear any unfired ammunition from the individual barrels.

More specifically, the hydraulic system includes an accumulator for containing a supply of hydraulic fluid, and means for initially pressurizing the hydraulic fluid contained in the accumulator. The hydraulic system includes a hydraulic motor/pump unit having a rotatable shaft coupled to either drive or be driven by the barrel cluster. The motor/pump unit is operable in a motoring mode wherein pressurized fluid is supplied to the motor/pump to drive the barrel cluster, and is also operable in a pumping mode wherein the barrel cluster drives the motor/pump unit to produce pressurized fluid. Typically, the hydraulic motor/pump unit is a variable displacement bidirectional unit which can be operated in the motoring mode or the pumping mode in either direction.

The hydraulic starting system also includes means for connecting the accumulator to the motor/pump unit and controlling fluid flow therebetween. A servo mechanism is provided for controlling the operating mode of the motor/pump unit. The servo mechanism initially operates the motor/pump unit in the motoring mode wherein pressurized fluid from the accumulator is supplied to the motor/pump unit to initially rotate and accelerate the barrel cluster in a firing direction until the rotation of the barrel cluster is sustained by the gun gas drive unit and, wherein during the firing mode the servo mechanism operates the motor/pump unit in the pumping mode wherein the motor/pump unit is powered by the gun gas driven barrel cluster to supply pressurized fluid to recharge the accumulator.

The hydraulic starting system can further include means for controlling the rotational speed of the barrel cluster in the firing direction at a predetermined firing speed when the gun is operated in the firing mode. In this case, the motor/pump is a variable displacement type, and means are provided for varying the displacement of the motor/pump unit when the gun is operated in the firing mode to maintain the speed of the barrel cluster at the predetermined firing speed. Once the firing cycle is completed, the servo means is adapted to set the motor/pump unit in the full pumping mode to load the barrel cluster and cause braking of the barrel cluster.

After the barrel cluster has been braked, it is typically necessary to operate the Gatling gun in a reverse mode such that a reverse clearing mechanism can remove any unfired ammunition from the barrel cluster. The hydraulic system of the present invention includes means for driving the barrel cluster in a direction opposite the firing direction after the barrel cluster has been braked, thereby enabling the reverse clearing mechanism to clear the barrel cluster.

BRIEF DESCRIPTION OF THE DRAWINGS

FIG. 1 is a simplified perspective view illustrating a Gatling gun which incorporates the regenerative starter/speed regulator of the present invention;

FIG. 2 is a simplified block diagram illustrating the major components of the regenerative starter/speed regulator system of the present invention;

DESCRIPTION OF THE PREFERRED EMBODIMENT

Figure 3:
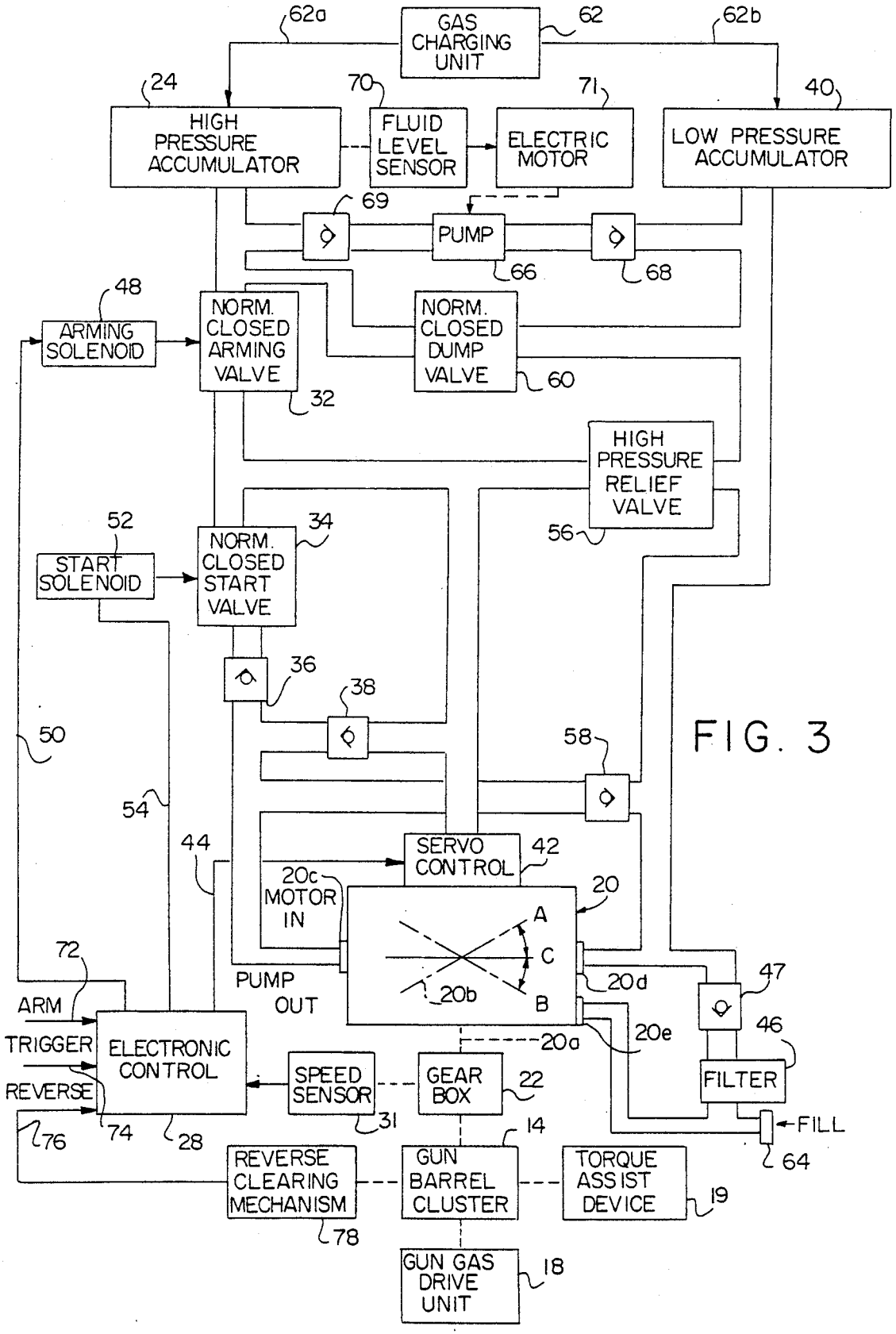
FIG. 3 is a block diagram illustrating in more detail the hydraulic control components utilized in the regenerative starter/speed regulator.

Referring to the drawings, there is shown in FIG. 1 a simplified perspective view of a Gatling gun 10 which is adapted to utilize the regenerative starter/speed regulator system of the present invention, generally represented in FIG. 1 by reference numeral 12. The Gatling gun includes a plurality of individual barrels 14*a* grouped in a circular barrel cluster 14 for rotation about a common longitudinal gun axis X. The Gatling gun 10 includes an ammunition handling system 16 which, for example, may be of the type shown in U.S. Pat. No. 4,004,490 which is herein incorporated by reference. As the barrel cluster 14 is rotated, the ammunition handling system 16 serially loads the individual barrels 14*a* and, after firing, subsequently clears the barrels for reloading.

Once the rotation of the barrel cluster 14 has been initiated by the regenerative starter system 12 of the present invention in a manner as will be discussed, the rotation of the barrel cluster will be maintained by the power produced by the combination of a gun gas drive unit 18 coupled to the barrel cluster and a muzzle brake torque assist device 19 fixed to the muzzle end of the rotating cluster 14. While the gas drive unit 18 can be of the type disclosed in U.S. Pat. No. 3,407,701, which is herein incorporated by reference, it will be appreciated that other types of Gatling gun gas drive units can be utilized. The muzzle brake torque assist device 19 can be, for example, of the type illustrated and described in U.S. Pat. No. 3,703,122, which is also incorporated herein by reference.

Basically, the regenerative starter/speed regulator system 12 is utilized to provide initial rotation and acceleration of the barrel cluster 14 until the gun gas drive unit 18 and the muzzle torque assist device 19 can provide sufficient power to maintain the desired firing speed of the barrel cluster. The system 12 can then be utilized as a regulator to maintain the speed of the barrel cluster at a controlled rate.

A simplified block diagram of the system 12 of the present invention is shown in FIG. 2. In FIG. 2, the gun barrel cluster 14, the gas drive unit 18, and the torque assist device 19 are represented by boxes with the mechanical interconnections therebetween represented by dashed lines. As shown in FIG. 2, the primary components of the starter/speed regulator system 12 include a hydraulic motor/pump 20 mechanically coupled to drive or be driven by the gun barrel cluster 14 through a gear box 22. The hydraulic motor/pump 20 is typically a variable displacement bidirectional unit which includes an output shaft (represented by dashed line 20*a*) which can be rotated in either direction when the motor/pump is operated in either the pumping or motoring mode. While various types of variable displacement hydraulic motor/pump units can be utilized, it has been found that an axial-piston motor of the type described on page 159 of the Sept. 29, 1983 issue of Machine Design provides very satisfactory results in the present application.

The hydraulic motor/pump 20 receives pressurized fluid from or supplies pressurized fluid to a high pressure accumulator 24 through a hydraulic control 26. As will be discussed, the hydraulic control 26 includes several solenoid operated valves and other flow control valves for controlling fluid flow between the accumulator 24 and the motor/pump 20, and also a servo means for controlling the displacement and the operating mode of the motor/pump 20. These valves and the servo means are operated by an electronic control 28 which receives input signals on lines 29 representing the desired operating mode of the gun system, and generates control signals on lines 30 to the hydraulic control 26. A speed sensor 31 is coupled to the gear box 22 and transmits a signal to the electronic control 28 representing the speed of the barrel 14.

When the electronic control 28 receives input signals on the lines 29 indicating that it is desired to initiate firing of the gun, the electronic control 28 generates output signals on the lines 30 to the hydraulic control 26 for setting the hydraulic motor/pump 20 to operate in the desired firing direction in a full motoring mode, while simultaneously supplying high pressure fluid from the accumulator 24 to the motor/pump 20, thereby rotating the connecting shaft 20*a* which then causes initial rotation and acceleration of the gun barrel cluster 14. As the speed of the gun barrel cluster 14 as sensed by the speed sensor 31 approaches the desired firing speed, the hydraulic control 26 will reduce the torque produced by the motor/pump 20.

Since the resultant torque produced by the combination of the gas drive unit 18 and the torque assist device 19 is typically greater than the torque necessary to drive the gun barrel cluster 14 at the desired speed, it is necessary to provide some type of speed regulation of the cluster. The present invention achieves this speed control by operating the hydraulic motor/pump 20 in a variable pumping mode, thereby applying a torque load to the gun barrel cluster. The pump displacement of the motor/pump 20 is controlled such that the torque load on the gun barrel cluster by the motor/pump maintains the rotational speed of the barrel cluster at a desired firing speed. In accordance with the present invention, during this speed regulating time period, the motor/pump 20 is operated in the pumping mode, and the pressurized fluid produced by the motor/pump 20 is supplied to repressurize the high pressure accumulator 24 such that high pressure fluid will be available to restart the gun.

There is shown in FIG. 3 a more detailed block diagram of the regenerative starter/speed regulator 12 of the present invention. As previously mentioned, the hydraulic motor/pump 20 (schematically shown in FIG. 3) is preferably a variable displacement axial piston motor/pump. In this type of motor/pump, a plurality of pistons (not shown) are arranged in an annular array about the shaft 20*a*. One end of each of the pistons is coupled to a yoke plate (represented by element 20*b*) which is positioned in a predetermined angular relationship with the longitudinal axis of the motor/pump to control the displacement of the motor/pump and also whether the motor/pump is operated in the pumping or motoring mode. In FIG. 3, when the shaft 20*a* rotates in one direction and the angled yoke plate 20*b* is positioned on the extreme one side of a centerline C (position A), the motor/pump 20 operates in a full motoring mode and, when the yoke plate 20*b* is positioned on the extreme opposite side of the centerline C (position B), the motor/pump 20 operates in the full pumping mode. When the motor shaft 20*a* rotates in the opposite direction, the motor/pump 20 operates in a full motoring mode when the yoke plate 20*b* is in position B and in a full pumping mode when in position A. By varying the angular position of the yoke plate 20*b* between positions A and B and the centerline C, the motor/pump can vary the torque produced in the motoring mode or the torque load which occurs in the pumping mode.

The motor/pump unit includes a high pressure port 20*c* connected to receive high pressure fluid from the high pressure accumulator 24 through a normally closed arming valve 32, a normally closed start valve 34, and a check valve 36. When the motor shaft 20*a* is rotating in the firing direction and the motor/pump unit is operating in the pumping mode, pressurized fluid from the high pressure port 20*c* is supplied to the accumulator 24 through a check valve 38 and the normally closed arming valve 32.

The motor/pump 20 includes a low pressure port 20*d* which is connected to a low pressure accumulator 40. The angular position of the yoke plate 20*b* is adjusted by a servo control 42 which receives actuating pressure from the high pressure accumulator 24 through the arming valve 32 and receives an electric control signal on a line 44 from the electronic control 28. The motor further includes a case drain port 20*e* which returns fluid to the low pressure accumulator 40 through a filter 46.

The normally closed arming valve 32 is actuated by an arming solenoid 48 adapted to receive an actuating signal on a line 50 from the electronic control 28, while the normally closed start valve 34 is actuated by a start solenoid 52 which receives an actuating signal on a line 54 from the electronic control 28. While not shown in the drawings, both the arming solenoid 48 and the start solenoid 52 can each include a pilot valve for actuating the respective valves 32 and 34.

When the system is operating in the pumping mode, and in the event the pressurized fluid being supplied to the accumulator 24 through the check valve 38 and the arming valve 32 exceeds a predetermined level, a normally closed high pressure relief valve 56 connected between the check valve 38 and the low pressure accumulator 40 will open, thereby causing fluid to flow into the low pressure accumulator 40 and prevent a pressure increase in the high pressure accumulator 24 above a predetermined level. An anti-cavitation check valve 58 is connected between the high pressure port 20*c* and the low pressure port 20*d* of the motor/pump 20 and prevents cavitation of the hydraulic fluid when the motor/pump 20 is operated in the motoring mode and the start valve 34 is closed. When it is desired to service the hydraulic system, the fluid pressure in the system can be equalized by actuating a normally closed manual dump valve 60 connected between the high pressure accumulator 24 and the low pressure accumulator 40.

The high pressure accumulator 24 and the low pressure accumulator 40 are precharged with gas to predetermined high and low pressures by means of a gas charging unit 62 through gas lines 62*a* and 62*b* respectively. After the accumulators 24 and 40 have been precharged with gas, the hydraulic system can be filled with a predetermined amount of hydraulic fluid through a fill port 64 connected to the low pressure accumulator 40 through the filter 46 and the check valve 47. While not shown in the drawings, bleed ports can be provided at selected locations in the system for insuring that the system is completely filled with fluid. Once the hydraulic fluid has been introduced into the system, the high pressure accumulator 24 can be filled to a predetermined level by means of a pump 66 having an inlet connected to the low pressure accumulator 40 through a check valve 68, and an outlet connected to the high pressure accumulator 24 through a check valve 69. The predetermined level to which the high pressure accumulator 24 is to be filled can be sensed by means of a fluid level sensor 70 which provides a signal to an electric motor 71 coupled to drive the pump 66.

In addition to receiving a signal representative of the rotational speed of the gun barrel cluster 14 from the speed sensor 31, the electronic control 28 also receives several other input signals. For example, the electronic control 28 receives an ARM signal on a line 72 when it is desired to arm the system, a TRIGGER signal on a line 74 when it is desired to fire the gun, and a REVERSE signal on a line 76 when it is desired to reverse the rotation of the gun barrel cluster 14 after firing in order to clear unfired rounds of ammunition. The REVERSE signal is generated by a reverse clearing mechanism 78 which, as will be discussed, is coupled to the barrel cluster 14 to clear any unfired ammunition which remains in the gun barrel cluster after termination of the firing mode.

Figure 4:
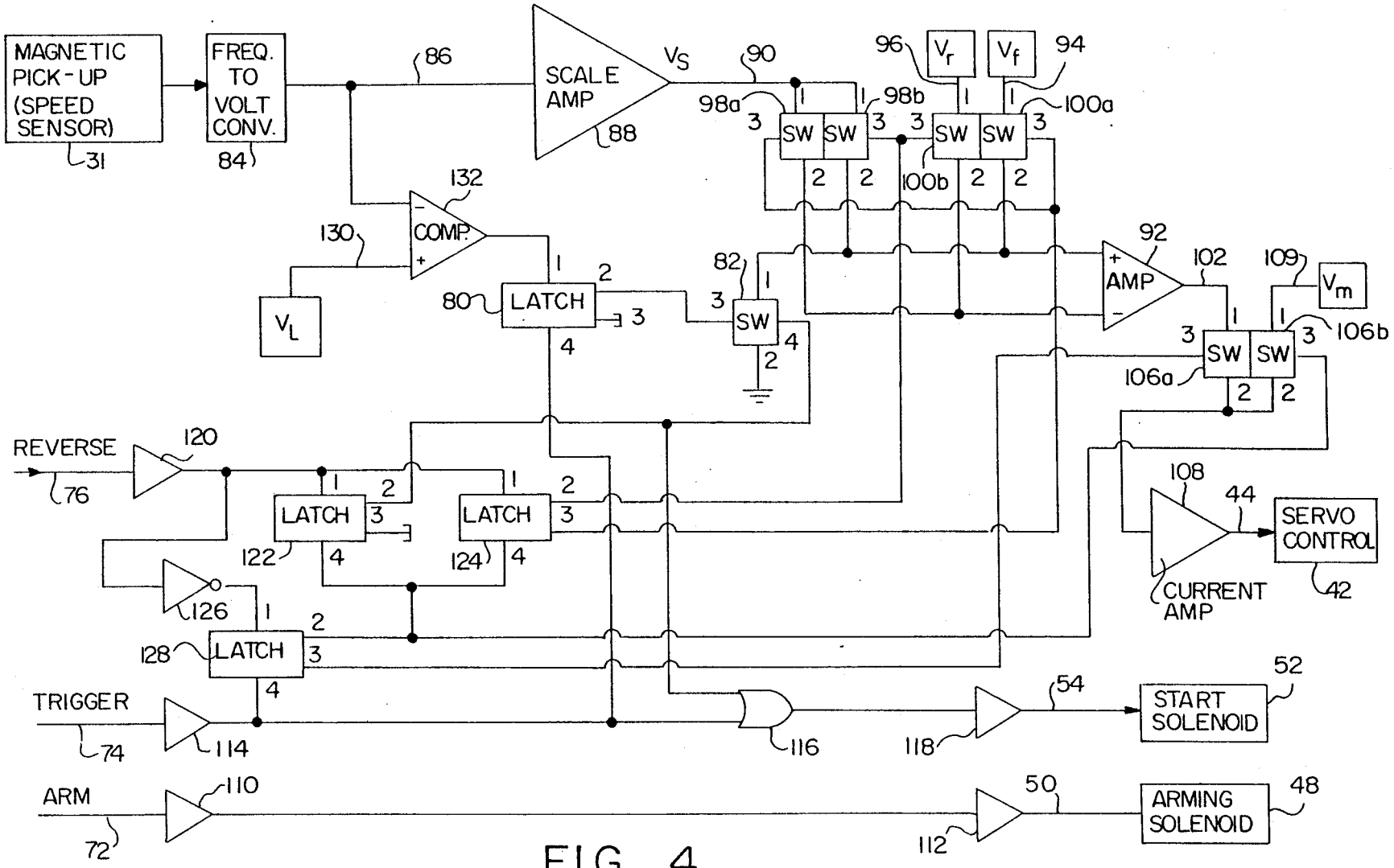
FIG. 4 is a block diagram illustrating the electronic control portion of the present invention.

A block diagram of the electronic control 28 is shown in FIG. 4. The block diagram of FIG. 4 includes a plurality of components, such as component 80, identified by the term "LATCH", and also a plurality of components, such as component 82, identified by the designation "SW". Each of the latches includes four connection terminals which, in the case of the latch 80, are identified as terminals 80-1, 80-2, 80-3 and 80-4. Terminal 80-1 represents a clock input, terminal 80-2 represents the latch output, terminal 80-3 represents the inverted latch output, and terminal 80-4 represents a clear input. When the clear terminal 80-4 is at a high logic level, the output terminal 80-2 will be maintained at a low logic level, and the inverted output terminal 80-3 will be maintained at a high logic level. When the clear input is at a low level, and a low to high transition occurs at the clock input terminal 80-1, the output terminal 80-2 will be set at a high level, and the inverted output terminal 80-3 will be set at a low level. The other latches shown in FIG. 4 include similar terminals and operate in a similar manner.

Each of the boxes marked "SW" represents a solid state switch which includes three connection terminals which, in the case of the switch 82, are identified as contact terminals 82-1 and 82-2 and a control input 82-3. When the control input 82-3 is at a high logic level, the switch is closed and the terminals 82-1 and 82-2 are connected to one another to provide a low resistance current path therethrough. When the control terminal 82-3 is at a low logic level, the switch is in an open state. Additionally, the switch 82 includes a fourth disable input 82-4 which, when this input is at a high logic level, maintains the switch in the open state, regardless of the level of the signal at the control input 82-3. The other switches in FIG. 4 do not include a disable input.

The electronic control 28 includes means for regulating the speed of the rotating barrel cluster. As shown in FIG. 4, the speed sensor 31 can be a magnetic pickup device which generates a signal having a frequency proportional to the rotational speed of the barrel cluster. This signal is supplied as an input to a frequency-to-voltage converter 84 which generates a signal on a line 86 having a voltage proportional to the speed of the barrel cluster. The output voltage on the line 86 from the converter 84 is supplied as an input to a scaling amplifier 88 which converts the signal to an appropriate level for subsequent comparison to a reference speed signal. The output of the scaling amplifier is generated on a line 90 as the $V_s$ signal.

At this point, the signal on the line 90 must be compared to a voltage reference signal representing the desired operating speed of the gun. This comparison function is performed by a differential amplifier 92. Depending on whether the motor/pump 20 is to be operated in the forward or the reverse direction, the actual speed signal $V_s$ must either be subtracted from a forward reference voltage signal $V_f$(generated on a line 94), or a reverse reference voltage signal $V_r$ (generated on a line 96) must be subtracted from the actual speed signal $V_s$. A plurality of switches 98*a*, 98*b*, 100*a*, and 100*b* are provided for connecting the $V_s$ signal and the respective reference signals to the appropriate inputs of the differential amplifier 92. When the motor/pump 20 is operated in the forward direction, a high level logic signal appears at terminals 98a-3 and 100a-3 to close the respective switches and connect the $V_s$ signal to the inverting input of the amplifier 92 and to connect the $V_f$ reference signal to the non-inverting input. When the logic level at control terminals 98a-3 and 100a-3 is at a high level, the logic level at the control terminals 98b-3 and 100b-3 will be at a low level, thus maintaining the respective switches in the open state. As will be discussed, the logic levels to the control terminals of the switches 98a, 98b, 100a, and 100b are inverted when the motor/pump 20 is operated in the reverse direction.

The differential amplifier 92 generates an output signal on a line 102 which is supplied through a switch 106a to the input of a current amplifier 108 which generates a current drive signal on the line 44 to the servo 42 having a level proportional to the magnitude of the input voltage.

Normally, the control terminal 106a-3 of the switch 106a is at a high logic level, while the control input 106b-3 of a switch 106b is at a low logic level. However, in certain instances as will be discussed, it is desirable to disconnect the output of the amplifier 92 from the input of the current amplifier 108 and supply the input of the current amplifier 108 with a predetermined voltage signal $V_m$ (generated on a line 109) which causes the yoke plate 20b of the motor/pump 20 to swing to a full motoring position. As will be discussed, this operation is performed at the end of the reverse clearing cycle to set the yoke plate in the proper position for restart of the system.

As shown along the bottom of FIG. 4, the ARM signal on the line 72 is supplied through a pair of serially connected buffers 110 and 112 to generate an actuating signal on the line 50 to actuate the arming solenoid 48. Thus, when the ARM signal is at a high level, the arming solenoid 48 will be actuated and the normally closed arming valve 32 will be open. The TRIGGER signal on the line 74 is supplied through a buffer 114 as one input to an OR gate 116. The output of the OR gate 116 is connected through a buffer 118 to the line 54 to actuate the start solenoid 52. Thus, when the TRIGGER signal is at a high logic level, a high logic level will appear on the line 54 to actuate the start solenoid 52 and open the start valve 34. The REVERSE signal on the line 76 is supplied through a buffer 120 to clock inputs 122-1 and 124-1 of latches 122 and 124. The output signal of the buffer 120 is also supplied as an input to an inverter 126 which generates an output signal to a clock input 128-1 of a latch 128.

When it is desired to initiate reverse clearing of the gun barrel cluster, the reverse clearing mechanism 78 produces a high level logic signal on the line 76 and, when the reverse clearing operation is completed, the high level logic signal on the line 76 is returned to a low logic level. The latches 122, 124 and 128 are adapted to control the various switches in the circuit necessary to operate the motor/pump 20 in the reverse direction. The latch 122 has an output 122-2 connected to a second input of the OR gate 116. When a high level signal appears on the line 76, the low-to-high transition at the clock input 122-1 causes the output 122-2 to be set to a high level, thus causing the OR gate 116 to generate a high level signal to actuate the start solenoid 52 and open the start valve 34. The latch output 122-3 is unconnected.

The latch 124 has output terminals 124-2 and 124-3 connected to the appropriate control inputs of the switches 98a, 98b, 100a, and 100b, to reverse the input connections to the amplifier 92 during the reversing mode. The latch 128 has output terminals 128-2 and 128-3 connected to control the switches 106a and 106b. The clear input 128-4 of the latch 128 is connected to the output of the buffer 114 to receive the TRIGGER signal. Thus, when the TRIGGER signal is generated, the latch outputs 128-2 and 128-3 will be set at a low and high level respectively to close switch 106a and open switch 106b. The latch output 128-2 is also connected to the clear inputs 122-4 and 124-4 of the latches 122 and 124. At the completion of the REVERSE signal, the inverter 126 clocks the latch input 128-1 to set the outputs 128-2 and 128-3 to a high and low level respectively and cause the switches 106a and 106b to change states, thereby disconnecting the output of the amplifier 92 from the current amplifier 108 and causing the voltage level $V_m$ to be supplied to the current amplifier 108 to move the yoke plate 20b to its full motoring position.

After the TRIGGER signal has been discontinued, it is desirable to permit the barrel cluster to coast for a predetermined time period in order to allow the firing pin (not shown) of the gun to be fully retracted. Once the firing pin has been fully retracted, it is then desirable to brake the barrel cluster and decelerate the cluster as rapidly as possible. In FIG. 4, these functions are achieved by comparing the signal on the line 86 representing the speed of the barrel cluster with a predetermined low speed signal $V_L$ generated on a line 130 and, after the TRIGGER signal is discontinued and the barrel cluster has coasted to a speed below this predetermined level, the servo is operated to move the yoke plate 20b to a full pumping position, thus providing a maximum torque load on the barrel cluster to decelerate the barrel cluster as rapidly as possible.

In FIG. 4, a comparator 132 has an inverting input connected to receive the actual speed signal on the line 86, and a non-inverting input connected to receive the low speed signal $V_L$ on the line 130. The output of the comparator 132 is supplied to the clock input 80-1 of the latch 80 which is connected to control the switch 82. The latch has a clear input 80-4 connected to receive the TRIGGER signal and an output 80-2 connected to the control input 82-3 of the switch 80. The switch 82 has one contact terminal 82-1 connected to the non-inverting input of the amplifier 92, and a second contact terminal 82-2 connected to the circuit ground potential.

When a TRIGGER signal is generated on the line 74, a high level signal will appear at the latch clear input 80-4, thus maintaining the output 80-2 at a low logic level such that the switch 82 remains open. When the TRIGGER signal is not present, and the speed of the barrel cluster falls below the low speed limit, the comparator 132 produces a low to high level transition at the clock input 80-1 to set the latch output 80-2 at a high level, thus closing the switch 82 and applying a ground potential signal to the non-inverting input of the differential amplifier 92. Under these circumstances, the amplifier 92 will generate a voltage signal on the line 44 to the current amplifier 108 which causes the servo 42 to move the yoke plate 20b over center from a full motoring position to a full pumping position, thus loading and braking the barrel cluster 14.

After the cluster has been sufficiently decelerated and the REVERSE signal subsequently appears on the line 76, the output 122-2 of the latch 122 will be set at a high level to supply a high level logic signal to the disable terminal 82-4 of the switch 82. When the level of the signal at the terminal 82-4 is at a high level, the switch 82 will open, regardless of the level of the signal at the control input 82-3.

Figure 5:
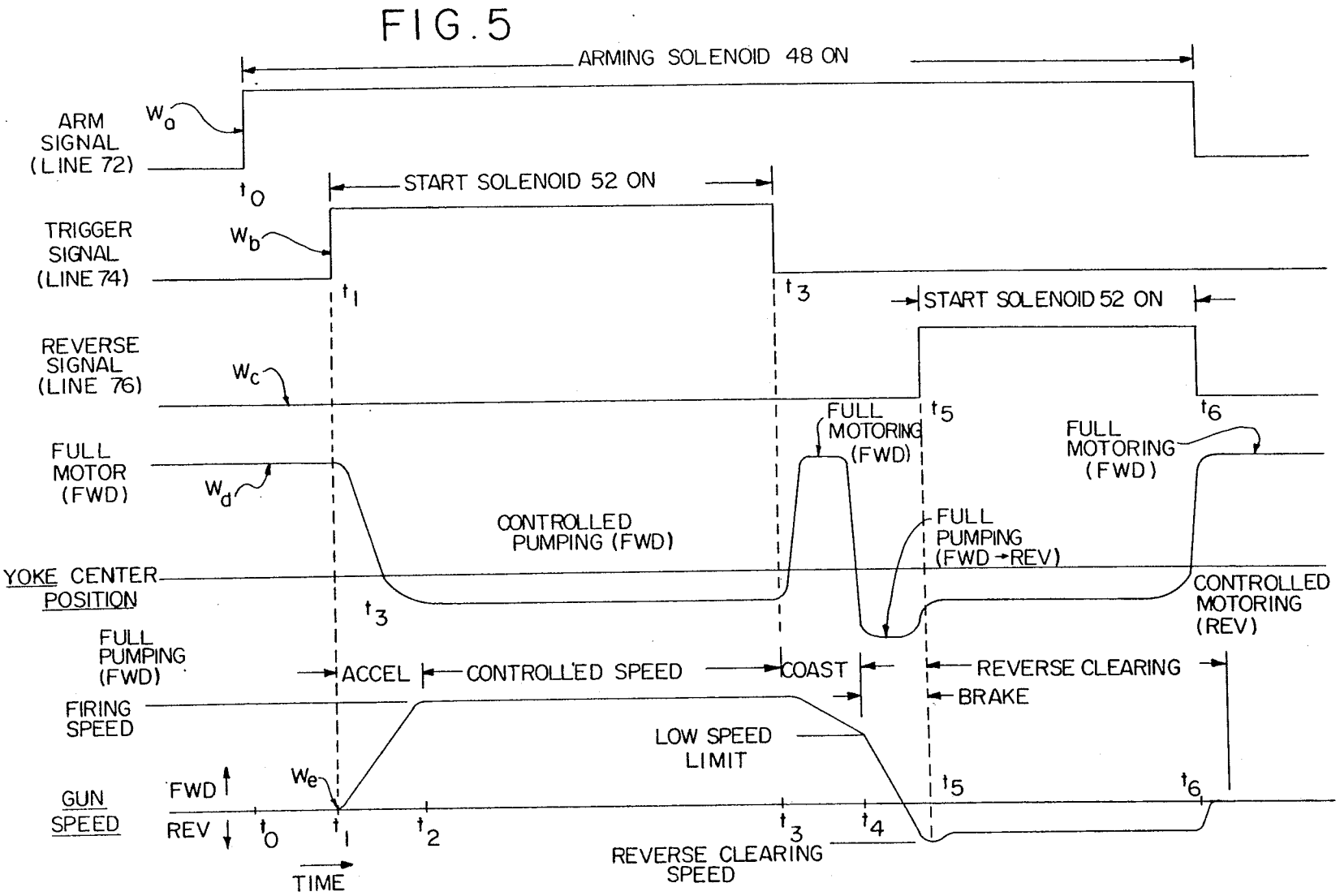
FIG. 5 is a waveform diagram illustrating the overall operation of the regenerative starter/speed regulator system of the present invention.

Referring to FIG. 5, the overall operation of the regenerative starter/speed regulator of the present invention will now be discussed with reference to FIGS. 3 and 4 In FIG. 5, there is shown a waveform $W_A$ which illustrates the level of the ARM signal on the line 72 and thus the time period over which the arming solenoid 48 is actuated and the arming valve 32 remains open. Waveforms $W_B$ and $W_C$ illustrate the levels of the TRIGGER signal (line 74) and the REVERSE signal (line 76) and thus represent the time periods over which the start solenoid 52 is actuated and the start valve 34 remains open. Waveform $W_D$ represents the various operating modes of the hydraulic motor/pump 20 as it is controlled by the servo unit 42 in response to control signals from the electronic control 28. Waveform $W_E$ represents the actual speed of the barrel cluster during the controlled time period.

Initially, and prior to the generation of the ARM signal, the yoke plate **20*b* of the motor/pump 20 is positioned such that, when the motor/pump 20 is rotated in the forward firing direction, the unit will be in a full motoring mode. As previously mentioned with respect to FIG. 4, the yoke plate 20*b* is moved to the full motoring position by closing the switch 106*b* at the completion of the reverse clearing cycle to supply the voltage $V_m$ to the current amplifier 108 which causes the servo to swing the yoke plate 20*b* to its full motoring position. When the ARM signal (Waveform $W_A$) is generated (at time $T_0$) on the line 72, an actuating signal is generated on the line 50 to actuate the arming solenoid 48 and open the arming valve 32. The arming valve 32 supplies pressurized fluid from the high pressure accumulator 24 to the servo control 42** and initializes the system for firing.

When it is desired to fire the gun, the TRIGGER signal as shown in waveform $W_B$ is generated (at time $t_1$) on the line 74. This causes an actuating signal to be supplied on the line 54 to the start solenoid 52, thereby opening the start valve 34 and supplying pressurized fluid to the high pressure port **20*c* of the motor/pump 20. Since at this time the yoke plate 20*b* is in its full motoring position, the motor shaft 20*a* will cause the gun barrel cluster to be accelerated at the maximum rate. During this time period, the acceleration rate of the barrel cluster 14 is monitored such that, as the barrel cluster 14 approaches its desired operating speed, the servo control 42 causes the yoke plate 20*b* to swing toward its center position, thereby reducing the torque supplied to the barrel cluster 14. As the barrel cluster approaches the desired firing speed, the gun gas drive unit 18 and the torque assist device 19** combine to produce torque at a higher level than is necessary to maintain the barrel cluster at the desired firing speed.

As the torque supplied by the gas drive unit 18 and the torque assist device 19 causes the gun speed to exceed the predetermined firing speed, the servo unit 42 causes the yoke plate **20*b* to swing over center (at time $t_2$) and thus be operated in the pumping mode. When the motor/pump 20 is operated in the pumping mode, pressurized fluid from the high pressure port 20*c* flows through the check valve 38 and the arming valve 32 to repressurize the accumulator 24 for the next start cycle. As long as the TRIGGER signal is generated, the gun speed will be controlled at the desired firing speed by controlling the pumping rate of the motor/pump 20. If, during this period, the pressure in the accumulator 24 exceeds a predetermined level, the high pressure relief valve 56 will open to supply fluid to the low pressure accumulator 40**.

When the TRIGGER signal is discontinued (at time $t_3$), the actuating signal on the line 54 to the start solenoid 52 is also discontinued, thereby causing the start valve 34 to close and cut off the supply of pressurized fluid to the high pressure port **20*c*. As previously mentioned, at this time it is desirable to permit the barrel cluster to coast for a predetermined time period to enable the gun firing pin (not shown) to be retracted. As the torque supplied by the gas drive unit 18 and the torque assist device 19 diminishes, the speed of the barrel cluster 14 will fall. This causes the speed control portion of the electric control 28, which is attempting to control the servo 42 to maintain the gun speed at the predetermined firing speed, to operate the servo 42 to swing the yoke plate to a full motoring position. During this coasting mode, the barrel speed falls and fluid flows through the anti-cavitation check valve 58**.

When the barrel cluster 14 has coasted to a speed less than the predetermined low speed limit shown in FIG. 5, the output of the comparator 132 will switch from a low level to a high level (at time $t_4$). Since at this time the trigger signal has been discontinued and the latch clear input 80-4 is at a low level, the output 80-2 of the latch 80 will be set at a high level, thereby closing the switch 82 and supplying a ground potential to the non-inverting input of the amplifier 92. This causes the current amplifier 108 to generate a signal to the servo control 42 to swing the yoke plate **20*b*** from its full motoring position to its full pumping position, thereby creating an additional torque load on the barrel cluster to decelerate and brake the barrel.

After the gun barrel has decelerated sufficiently and the yoke plate **20*b* has been swung to a full pumping position, the reverse clearing mechanism 78 generates the REVERSE signal (at time $t_5$) on the line 76 to produce a low-to-high transition at the clock inputs 122-1 and 124-1 of the latches 122 and 124 to set the latches 122 and 124. Setting the latch 122 produces a high level signal at the output 122-2 which is supplied to the control terminal 82-4 of the switch 82 to open the switch and remove the ground potential signal from the non-inverting input of the amplifier 92. Setting the latch 124 controls the switches 98*a*, 98*b*, 100*a*, and 100*b*** such that the reverse reference voltage $V_r$ is now compared with the actual speed signal $V_s$ to control the speed in the reverse direction at a predetermined level. Typically, the desired reverse operating speed is less than the desired firing rate speed.

When the reverse clearing mechanism 78 has sensed that all of the live ammunition has been cleared from the barrel cluster, the REVERSE signal will be terminated (at time $t_6$). This causes a low to high level transition to appear at the clock input 128-1 of the latch 128 to set the latch 128, thereby changing the status of the switches **106*a* and 106*b* and causing the $V_m$ voltage signal to be supplied to the current amplifier 108 to swing the yoke plate 20*b* to the full motoring position. When the TRIGGER signal reappears, the latch 128 is cleared at input 128-4 and the switches 106*a* and 106*b* reconnect the output of the amplifier 92 to the current amplifier 108**.

In accordance with the provisions of the patent statutes, the principle and mode of operation of the present invention have been illustrated and described in what is considered to represent its preferred embodiment. However, it should be understood that the present invention may be practiced otherwise than as specifically illustrated and described without departing from the spirit or scope of the attached claims.

What is claimed is:

1. A regenerative hydraulic starting system for providing initial rotation and acceleration of a rotatable barrel cluster of a Gatling gun having a gun gas drive unit for rotating the barrel cluster during the firing mode and after starting has been initiated, said system comprising:

a high pressure accumulator for containing a supply of relatively high pressure hydraulic fluid;

a low pressure accumulator for containing a supply of relatively low pressure hydraulic fluid;

a hydraulic motor/pump unit having a shaft coupled to the barrel cluster and having a high pressure port and a low pressure port, said hydraulic motor/pump unit operable in a motoring mode wherein pressurized fluid is supplied to said hydraulic motor/pump unit to drive the barrel cluster, and also operable in a pumping mode wherein the barrel cluster drives said hydraulic motor/-pump unit to produce pressurized fluid;

first conduit means for supplying pressurized fluid from said high pressure accumulator to said high pressure port of said hydraulic motor/pump unit;

second conduit means for supplying pressurized fluid from said high pressure port of said hydraulic motor/pump unit to said high pressure accumulator;

third conduit means for connecting said low pressure port to said hydraulic motor/pump unit to said low pressure accumulator; and servo means for controlling the operating mode of said hydraulic motor/pump unit, said servo means initially operating said hydraulic motor/pump unit in said motoring mode wherein pressurized fluid from said accumulator is supplied to said hydraulic motor/pump unit to initially rotate and accelerate the barrel cluster in a firing direction until the rotation of the barrel cluster is sustained by the gun gas drive unit, and wherein during the firing mode said servo means operates said hydraulic motor/pump unit in said pumping mode wherein said hydraulic motor/pump unit is powered by the gun gas driven barrel cluster to supply pressurized fluid to recharge said accumulator.

2. The hydraulic starting system according to claim 1 and further including means for controlling the rotational speed of the barrel cluster in said firing direction at a predetermined firing speed when the gun is operated in the firing mode.

3. The hydraulic starting system according to claim 2 wherein said hydraulic motor/pump unit is a variable displacement motor/pump unit and the displacement of said unit is controlled by said servo means, said speed control means including means for controlling said servo means to vary the displacement of said hydraulic motor/pump unit when the gun is operated in the firing mode to maintain the speed of the barrel cluster at said predetermined firing speed.

4. The hydraulic starting system according to claim 3 wherein the gun gas drive unit generates sufficient power during said firing mode to rotate the barrel cluster at a speed greater than said predetermined firing speed, and said speed control means controls said servo means to operate said hydraulic motor/pump unit in a pumping mode to produce a variable load on the barrel cluster to maintain the speed of the barrel cluster at said predetermined firing speed.

5. The hydraulic starting system according to claim 1 including means for controlling said servo means to operate said hydraulic motor/pump unit in said pumping mode after the firing mode is terminated and after the gun gas drive unit is disabled such that said hydraulic motor/pump unit loads the barrel cluster and thus causes braking of the barrel cluster.

6. The hydraulic starting system according to claim 5 including means for controlling said servo means after the gun gas drive unit is disabled and prior to the braking of the barrel cluster to operate said hydraulic motor/pump unit in said motoring mode for a predetermined time period, thereby enabling the barrel cluster to coast for a predetermined time period.

7. The hydraulic starting system according to claim 1 wherein the Gatling gun includes a reverse clearing mechanism to remove unfired ammunition from the barrel cluster after the firing operation is terminated and the gun gas drive unit has been disabled, and said hydraulic starting system includes means for driving the barrel cluster in a direction opposite said firing direction after the gun gas drive unit is disabled, thereby enabling the reverse clearing mechanism to clear the barrel cluster.

8. The hydraulic starting system according to claim 7 wherein said hydraulic motor/pump unit is operable in a reverse motoring mode to rotate said shaft and said barrel cluster in a direction opposite said firing direction, and said servo means includes means for operating said hydraulic motor/pump unit in said reverse motoring mode for a predetermined time period to enable reverse clearing of the barrel cluster.

9. The hydraulic starting system according to claim 8 including means for maintaining the speed of the barrel cluster at a predetermined speed when the barrel cluster is rotated in said opposite direction.

10. The hydraulic system according to claim 1 wherein said first conduit means includes a normally closed start valve responsive to a trigger signal for opening and supplying pressurized fluid from said high pressure accumulator to said hydraulic motor/pump unit when said motor/pump unit is operated in said motoring mode, and a check valve for permitting fluid flow through said first conduit means in only one direction from said high pressure accumulator to said high pressure port.

11. The hydraulic system according to claim 1 wherein said second conduit means includes a check valve for permitting fluid flow through said second conduit means in only one direction from said high pressure port to said high pressure accumulator.

12. The hydraulic system according to claim 1 including a high pressure relief valve connected between said high pressure accumulator and said low pressure accumulator.

13. The hydraulic system according to claim 1 including a fourth conduit means connected between said high pressure port and said low pressure port of said hydraulic motor/pump unit, said fourth conduit means including an anti-cavitation check valve for permitting fluid flow through said fourth conduit means in only one direction from said low pressure port to said high pressure port.

14. The hydraulic system according to claim 1 wherein said servo means is hydraulically actuated and is connected to receive pressurized fluid from said high pressure accumulator through a normally closed arming valve, said normally closed arming valve responsive to an arming signal for opening and supplying pressure to said servo means.

15. The hydraulic system according to claim 14 wherein said first conduit means and said second conduit means are connected to said high pressure accumulator through said normally closed arming valve.

16. The hydraulic system according to claim 1 including a speed sensor for generating an actual speed signal representing the actual speed of said barrel cluster, and means for generating a reference firing speed signal representing the desired firing speed of said barrel cluster, and control means responsive to said actual speed signal and said reference firing speed signal for generating a servo control signal to said servo means to control said hydraulic motor/pump unit to maintain the speed of the barrel cluster at said desired firing speed when the barrel cluster is operated in the firing mode.

17. The hydraulic system according to claim 1 including means for introducing an initial gas charge into said high pressure accumulator and pump means for transferring at least a portion of the fluid contained in said low pressure accumulator to said high pressure accumulator whereby said gas charge is adapted to maintain the supply of fluid contained in said high pressure accumulator at a predetermined pressure.

18. The hydraulic starting system according to claim 1 including means for introducing an initial gas charge into said high pressure accumulator and pump means for transferring at least a portion of the fluid contained in said low pressure accumulator to said high pressure accumulator whereby said gas charge is adapted to maintain the supply of fluid contained in said high pressure accumulator at a predetermined pressure.

* * * * *